United States Patent [19]

Corum

[11] Patent Number: 4,751,515

[45] **Date of Patent: * Jun. 14, 1988**

[54] ELECTROMAGNETIC STRUCTURE AND METHOD

[76] Inventor: James F. Corum, Rte. 9, Box 207-B, Morgantown, W. Va. 26505

[ * ] Notice: The portion of the term of this patent subsequent to Nov. 11, 2003 has been disclaimed.

[21] Appl. No.: 888,494

[22] Filed: Jul. 23, 1986

Related U.S. Application Data

[63] Continuation of Ser. No. 795,721, Nov. 7, 1985, Pat. No. 4,622,558, which is a continuation of Ser. No. 514,176, Jul. 15, 1983, abandoned, which is a continuation-in-part of Ser. No. 167,329, Jul. 9, 1980, abandoned.

[51] Int. Cl.[4] ..... H01Q 11/12

[52] U.S. Cl. ..... 343/742; 343/744

[58] Field of Search ..... 343/742, 744, 743, 856, 343/895, 908

[56] References Cited

U.S. PATENT DOCUMENTS

| | | | |
|---|---|---|---|
| 3,278,937 | 3/1966 | Leydorf | 343/856 |
| 3,365,721 | 5/1968 | Bittner | 343/856 |
| 3,646,562 | 2/1972 | Acker et al. | 343/720 |
| 4,622,558 | 11/1986 | Corum | 343/742 |

FOREIGN PATENT DOCUMENTS 1751249 1/1957 Fed. Rep. of Germany .

*Primary Examiner*—William L. Sikes
*Assistant Examiner*—Hoanganh Le
*Attorney, Agent, or Firm*—Jeffrey A. Wyand

[57] ABSTRACT

An electrically small, efficient electromagnetic structure, that may be used as an antenna or waveguide probe, having an electromagnetically closed, velocity-inhibiting conducting path, for supporting a standing, inhibited-velocity wave in response to the flow of an electrical current through the path and a process for establishing the standing wave. Use of the structure is particularly advantageous at the lower end of the electromagnetic spectrum, where various embodiments produce purely vertically polarized radiation in directional and omnidirectional patterns. Various embodiments of the structure include multiple conducting paths and image means to complete the conducting path. Embodiments of the structure may be used to excite the earth-ionosphere cavity at the Schumann resonances.

26 Claims, 10 Drawing Sheets

ELECTROMAGNETIC STRUCTURE AND METHOD

This patent application is a continuation of patent application Ser. No. 795,721, filed Nov. 7, 1985, now U.S. Pat. No. 4,622,558, which was a continuation of patent application Ser. No. 514,176, filed July 15, 1983, and is now abandoned, which itself was a continuation-in-part of patent application Ser. No. 167,329, filed July 9, 1980, and is now also abandoned.

BACKGROUND OF THE INVENTION

The present application relates to electromagnetic structures that can function as antennas for transmitting or receiving electromagnetic energy and as waveguide probes in cavities for injection or extraction of electromagnetic energy.

It is well known in the electromagnetic arts that efficient, linear antennas are usually constructed from elements having lengths that are significant portions of a free-space wavelength at the operating frequency. It is also known that if those lengths are made equal to integer multiples of one quarter wavelength, standing waves may be induced in the antenna. It is also understood that operation of an antenna at one of its self-resonance frequencies, if possible, is desirable to increase antenna efficiency. At the self-resonant frequencies, standing waves are produced on antennas and the reactive component of the feedpoint impedance is zero. This efficient operation contrasts with the familiar "matched" operation where the impedance of an antenna is conjugately matched by an external network to the impedance of a transmitter or receiver to improve performance. Reactive power losses are experienced both in the antenna and in the matching network, when a matching network is used, so that overall system efficiency is not maximized. It is also established that horizontally polarized electromagnetic waves suffer greater ground wave propagation losses than do vertically polarized waves. Therefore, vertically polarized waves are preferred over horizontally polarized waves for communication over the surface of the earth.

It is recognized that a vertical antenna having a length equal to one quarter of a wavelength at the operating provides a desirable vertically polarized, omnidirectional radiation pattern. However, because wavelength increases inversely with operating frequency, the length, i.e., the height, of such an antenna becomes unmanageably long at frequencies below about 1 MHz. As a consequence of the long wavelengths below 1 MHz, various antenna structures have been employed at those frequencies. Generally, those antenna structures are physically large, may not necessarily produce the desired vertically polarized signal, and are not self-resonant. Therefore they are inherently inefficient as well as being unwieldy.

The goal of constructing a physically small, but self-resonant (and therefore efficient) antenna or waveguide probe has eluded electromagnetic arts specialists for over three-quarters of a century. An antenna or other electromagnetic structure is electrically small when its physical size is small relative to the free-space wavelength at which it operates. Thus, at the lower end of the radio frequency spectrum where wavelengths are relatively long, a physically large electromagnetic structure may still be electrically small. As used here, the term "electrically small" means that the physical dimensions of an electromagnetic structure, measured in terms of free-space wavelengths, at the operating frequency, are small, whether or not the structure may be electromagnetically self-resonant.

SUMMARY OF THE INVENTION

In the present invention electrically small, yet self-resonant and, therefore, efficient, electromagnetic structures are disclosed. These structures may be used as antennas or waveguide probes. By employing a slow wave structure including an electromagnetically closed path and by operating the structure at one of the frequencies at which an inhibited-velocity standing wave is established along the closed path, a small, yet self-resonant, i.e., efficient, antenna or probe may be achieved. These structures are not only self-resonant (i.e., have a non-reactive input impedance), but also possess relatively large radiation resistances.

A particularly useful embodiment of the inventive structure, and one that may be used as a building block to build more complex structures, includes a toroidal, helical electrically conducting path. In a simple case, the structure has a single conductive path, such as a copper wire or other electrical conductor, disposed on the surface of a torus in uniformly spaced turns. The axis of the helical path lies on a circle which is described by the major radius of the torus. (A toroidal surface is generated by the rotation of a closed planar figure about a rotational axis lying outside the figure. When that figure is a circle, the surface generated is a torus. For a torus, the distance between the rotational axis and the center of the rotated circle is the torus' major radius.) When the conducting path on the toroidal surface is electrically excited in a pre-selected frequency range, a pair of slow electromagnetic waves, i.e., ones with propagation velocities less then the speed of light, propagates along the path. At the resonance frequencies of the toroidal path, an inhibited-velocity standing wave is established along the electromagnetically-closed path, which in this elementary example is approximately equal to the circumference of the torus. Because of the inhibited-velocity propagation, i.e., the slow wave effects imparted by the structure, the standing wave that is established has an inhibited or guide wavelength. That wavelength is shorter than a free-space wavelength at the frequency of resonance. Therefore, at the primary resonance frequency, the toroidal structure behaves electrically as if its circumference were one free-space wavelength long when that circumference is actually physically smaller than one free-space wavelength. Thus an electrically small, resonant structure is achieved. The structure also has higher mode resonance frequencies. When it is operated at one of those frequencies the structure is electrically larger than at the primary resonance frequency.

By combining a number of the toroidal conducting paths just described and by controlling the relative phases of the electromagnetic energy supplied to each path, various embodiments of the inventive structure and various antenna radiation patterns may be created. In some embodiments of the invention including a plurality of toroidal conducting paths, the conducting paths have opposing senses, i.e., are contrawound. By appropriately feeding the contrawound paths, an electrically small, self-resonant antenna providing purely vertically polarized radiation having an omnidirectional radiation pattern may be realized. This is an especially important and useful achievement in the lower frequency ranges, an achievement that has totally eluded others in the electromagnetic arts. Other embodiments of the invention may be used to produce the same radiation patterns as known antennas, such as the turnstile antenna, but in an electrically small volume. By appropriately combining conducting paths, embodiments of the invention producing nearly any antenna polarization and radiation pattern may be realized.

Other embodiments of the inventive electromagnetic structures may be constructed having helical and non-helical electrical conducting paths disposed on other toroidal and non-toroidal surfaces. (Those surfaces may be physically existing coil forms or mathematical, conceptual surfaces not physically present in a particular embodiment of the inventive structure.) For example, the surface may include corners and/or have a cross section including corners and convolutions. An important element of the invention is that the path inhibit propagation, thereby creating slow waves, and provide an electromagnetically closed path so that a standing inhibited-velocity wave, meaning resonant operation, can be established in response to the flow of an electrical current through the path.

One half of the electrically conducting path may be eliminated in embodiments of the structure by employing the image theory technique. In these embodiments, a conducting image surface electrically supplies the missing portion of the path. The image surface may be a conducting sheet, a screen or wires arranged to act electrically as a conducting sheet, or may be the earth, in accordance with the disclosed improvement in known electromagnetic technology.

While the achievements of the invention are usable over a wide range of the radio frequency spectrum, they are particularly useful at the lower end of the spectrum where wavelengths are very long. Known antennas operating in that region of the spectrum are exceedingly large and inefficient. According to the invention, antennas no larger than a few thousandths of a free space wavelength at their primary resonance frequency may be constructed and may be operated efficiently at a resonance frequency or sufficiently close to a resonance frequency so as to be within the resonance frequency bandwidth. With such antennas reliable communication to deeply submerged submarines is possible and practicable.

A particularly intriguing application of the structure is the construction and operation of a waveguide probe at the primary or higher mode resonance frequencies of the waveguide formed by the surface of the earth and ionosphere. Because these resonance frequencies, the so-called Schumann resonances, are so low, e.g., about 8, 14 and 30 Hz, it has not heretofore been practical even to attempt to build a self-resonant structure to operate at any of the frequencies. Although a waveguide probe according to the invention resonantly operating at one of the Schumann resonance frequencies would be physically large, it would still be electrically small and therefore realizable, as well as efficient. Because propagation losses are so low at the primary Schumann resonance frequency (below 0.25 dB per Mm according to published data), signals at that frequency may be transmitted to any point on the earth without significant attenuation.

The invention may be more clearly understood from the detailed description that follows, particularly when taken in conjunction with the appended drawing figures.

BRIEF DESCRIPTION OF THE DRAWINGS

FIG. 19*a* is a view of the crossover current paths of the contrawound helical structure of FIG. 18*a.

DETAILED DESCRIPTION OF PREFERRED EMBODIMENTS

A slow wave structure forms an essential part of the invention. It is well known that in a slow wave structure electromagnetic waves propagate with a velocity less than the speed of light, the free-space propagation velocity. The relation between these velocities may be expressed as $$V_p = V_f c$$

where $V_p$=slow wave propagation velocity $V_f$=velocity factor, and c=speed of light.

The velocity factor may be on the order of 0.1 or less in many slow wave structures. In propagating along a slow wave structure, an alternating electric current has a guide wavelength, $\lambda_g$, that is related to other variables as $$\lambda_g = (V_p/f) = V_f \lambda_o$$

where the additional variables are f=frequency, and $\lambda_o$=a free-space wavelength at the frequency f.

Numerous slow wave structures are known in the art. Many have been used in microwave electron tubes. In the present invention slow wave structures are used to radiate electromagnetic energy, whereas in microwave tubes every attempt is made to suppress radiation by the slow wave structures. A particularly convenient slow wave structure for mathematical analysis and for construction of some preferred embodiments of the present invention is the helix.

Figure 1:
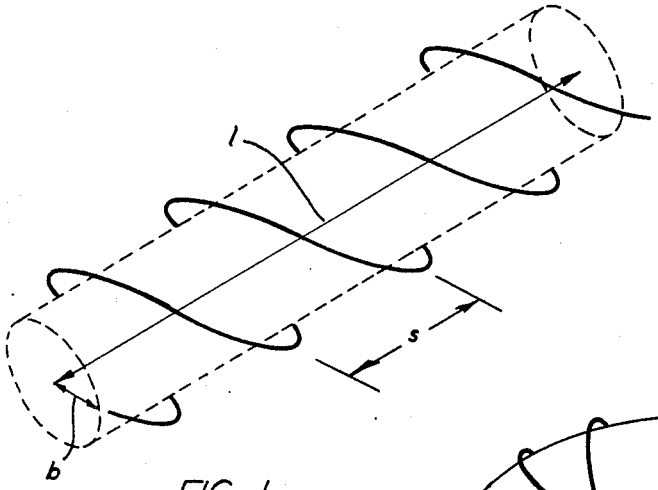
FIG. 1 Prior Art
FIG. 1 is a perspective view of a prior art linear, helical slow wave structure.

Linear Helix. A linear helical conductor of length l, radius b and "turn" spacing s is shown in FIG. 1. A useful formula for calculating the velocity factor, $V_f$, in a linear helix appears in *Reference Data for Radio Engineers* (Howard W. Sams Co., 1972) 25–11 ff.

$$V_f = \frac{1}{\left[1 + 20\left(\frac{2bn}{l}\right)^{5/2}\left(\frac{2b}{\lambda_o}\right)^{\frac{1}{2}}\right]^{\frac{1}{2}}} \quad (1)$$

where N=the number of turns (N=(l/s)), the other terms are as previously defined and it is assumed that $$\frac{4b^2}{s\lambda o} < \frac{1}{5}$$

Figure 2:
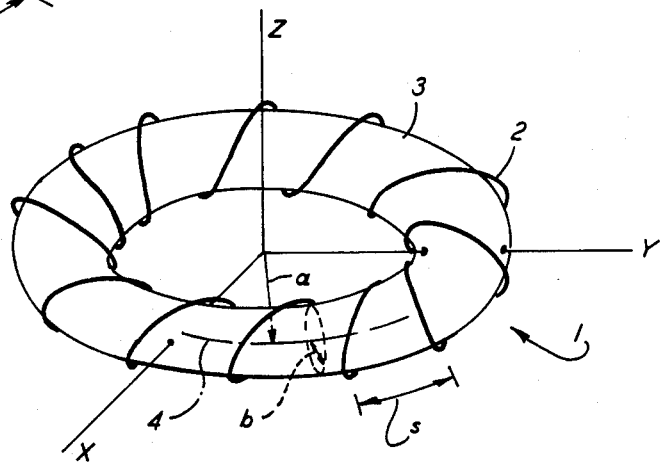
FIG. 2 is a perspective view of an embodiment of an electromagnetic structure according to the invention.

Elementary Toroidal Embodiment. The advantages of the invention are achieved when a standing wave is established, in response to the flow of current through a slow wave structure, along an electromagnetically closed wave path provided by a slow wave structure. An electromagnetically closed wave path may be created from the linear helix of FIG. 1 by conceptually bending the helix into a circle. A toroidal form 1, in this instance a torus, shown in FIG. 2, is then described. In FIG. 2, torus 1 is shown disposed along orthogonal Cartesian axes. A helical conducting path 2, which may be a copper wire, a metal tube, a metallic film or the like, is disposed on toroidal form 1. A surface 3 on which the path is disposed is a torus having two circular cross sections in each plane containing the Z axis. Those cross sections have the radius b, the minor radius of the torus. The centers of those cross-sectional circles describe a circle 4 lying in the XY plane and having a radius a, the major radius of the torus. The toroidal surface may be a dielectric form or it may be an imaginary surface if the conducting path 2 is self supporting. Alternately, the toroidal surface might be considered not as a bent cylinder, but as generated by rotating a circle of radius b about the Z axis which is spaced from the center of the circle by the distance a. Toroidal surfaces, other than a torus, are useful in the invention as surfaces for supporting a conducting path and may be similarly created by rotating a non-circular closed figure about an axis lying outside the figure. Still other surfaces, not the production of rotation of a closed figure may also be similarly used in embodiments of the invention. Likewise, the conducting path need not be helical, but could be spiral, that is, the "turns" of the path need not be equally spaced, i.e., of the same pitch, and the minor and major radii need not be constant. The toroidal, helical embodiment of FIG. 2 is, however, particularly useful for mathematical analysis as well as being a preferred embodiment. Torus 1 is one form of a multiply connected surface. The outside surface of torus 1 may also be described as one example of the outside surface of an endless tube. The circle described by major radius a is a closed figure forming a central axis of torus 1. Several different kinds of circumferences can be drawn on surface 3 of torus 1. For example, the circle described by minor radius b is circumferential. That circle of radius b is planar and its plane lies transverse to and intersects that central axis. I refer here to such circumferences, which need not be planar, that describe a surface that intersects the central axis of the torus as transverse or as being disposed transversely. Other circumferential lines may be drawn on surface 3. For example, a circle drawn on surface 3 concentric to the central axis of radius a, is circumferential. Those kinds of circumferences describe surfaces that do not intersect the central axis of the torus. I refer here to such circumferences, which need not be planar, as longitudinal or as longitudinally disposed. Still other circumferential lines lying on surface 3, such as the helical path described by conductor 2, are neither circumferentially transverse nor longitudinal, but only circumferential.

Applying Equation 1 to the torus of FIG. 2, it is noted that the length of the linear helix is now the circumference described by the major radius, i.e, $l=2\pi a$. The number of turns N is then, $N=(2\pi a/s)$. Equation 1 becomes $$V_f = \frac{1}{\left[1 + 20\left(\frac{2b}{s}\right)^{5/2}\left(\frac{2b}{\lambda_o}\right)^{\frac{1}{2}}\right]^{\frac{1}{2}}} \quad (2)$$

where all the variables have been previously defined.

I have found Equation 2 very useful for designing elementary and multifilar helical, toroidal embodiments of my invention. The velocity factor, $V_f$, can be varied by changing the size of the torus and the pitch of the helical path. When the structure of FIG. 2 is driven with a current at a frequency such that the circumference, $2\pi a$, is approximately equal to an integer number of guide wavelengths, $n\lambda_g$, self-resonance is achieved. That is, a standing wave is established along the electromagnetically closed path formed by bending the slow wave structure, the linear helix, to form a closed geometric figure, in this case a circle. It follows, as the mathematical analysis and measured, experimental results below demonstrate, that an electrically small antenna, which is efficient because it is self-resonant, is achieved in the invention. The circumference of the toroidal structure at the primary resonance frequency (N=1) is equal to one guide wavelength, $\lambda_g$, which is shorter than a free-space wavelength by the factor $V_f$. The diameter of the antenna is approximately 2a. If, for example, the velocity factor is 0.1, then the overall dimension of the antenna at the primary resonance frequency will be less than one thirtieth of a free-space wavelength, making it electrically small. In addition to the advantage of remarkably small electrical size, the invention enables simple achievement of special electromagnetic radiation properties not previously obtainable.

Figure 3:
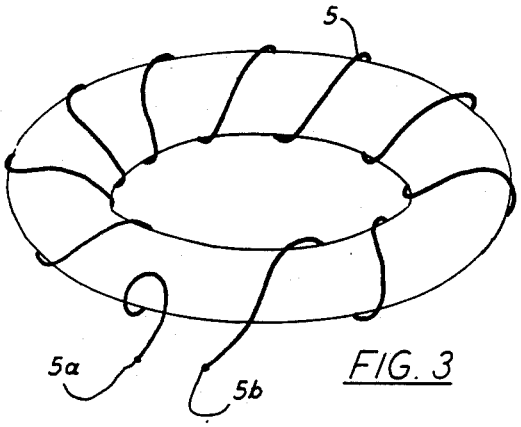
FIG. 3 shows an embodiment of an electromagnetic structure according to the invention adapted for a balanced feed.
Figure 4:
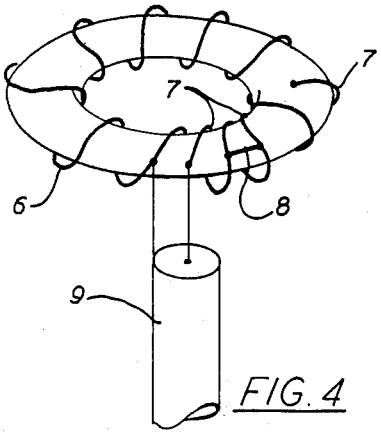
FIG. 4 shows an embodiment of an electromagnetic structure according to the invention adapted for an unbalanced feed.

In practice, the electrically conducting path of the structure must be electromagnetically excited and some means of supplying or extracting the energy must be provided. FIG. 3 shows the embodiment of FIG. 2 with a helical conducting path 5 cut to form two terminals 5*a* and 5*b* for a balanced feed. These terminals are sufficiently close to each other and are of the proper phase so as to appear, electromagnetically, to be closed. Thus the standing wave may still be established even though the path is not continuous on the toroidal surface. Similarly, in FIG. 4, the conducting path 6 is continuous and includes a short interleaved, discontinuous toroidal path 7. A sliding tap 8 connects conductors 6 and 7 so that an unbalanced feed, a coaxial cable 9, may be connected across conductors 6 and 7. Adjustment of the position of tap 8 permits variation of the impedance to permit impedance matching, if necessary. Obviously, embodiments of antennas according to the invention may operate either to radiate or receive electromagnetic energy.

Figure 5:
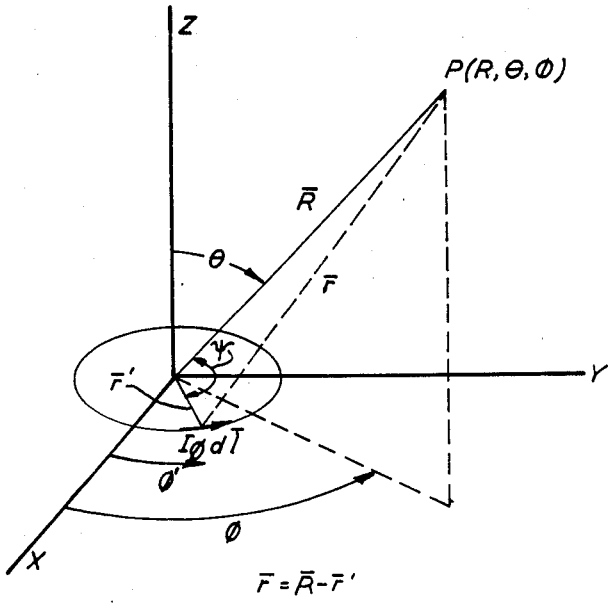
FIG. 5 shows a reference polar coordinate system used in the mathematical analysis of the embodiment of the invention shown in FIG. 2.

Mathematical Analysis. An approximate mathematical analysis of the radiation fields of the structure of FIG. 2 aids in understanding its performance and that of more complex embodiments of the inventive electromagnetic structure. In the mathematical analysis, it is convenient to use the polar coordinate system of FIG. 5 as a frame of reference. In the analysis is assumed that: (a) the radiation pattern is observed in the far field of the structure; (b) the helical conducting path is excited with a current non-uniformly distributed along the azimuthal angle, $\phi$, of FIG. 3; and (c) the helix can be decomposed into a continuous circular loop of sinusoidally distributed electrical current of the form $$I^e_\phi(\phi') = I_o \cos n\phi' e^{jwt}$$

and a continuous circular loop of sinusoidally distributed "magnetic current" of the form $$I^m_\phi(\phi') = I_m \sin(n\phi' + \alpha)e^{jwt}$$

where $\alpha$ represents a phase angle shift between the currents and n is an integer representing the resonance mode of the structure. Assuming the electric and magnetic currents are in phase quadrature, $\alpha=0$. When n=1, the structure is operating at its primary resonance frequency and $2\pi a \doteq \lambda_g$. Beginning with the source density of the field from the electric current as $$J(\vec{r}') = I_o \cos(n\phi')e^{jwt}\delta(\cos\theta')\frac{\delta(r'-a)}{a}\phi$$

and applying Maxwell's equations with the usual far field assumption, the intensity of the incremental magnetic field produced by the electrical current may be calculated. Neglecting negligible quantities, the $\theta$ and $\phi$ magnetic field intensity components may be calculated by direct integration. Then, from Maxwell's equations, the $\theta$ and $\phi$ components of the electric field attributable to the electric current may be determined. Similarly, the electric and magnetic fields generated by the loop of "magnetic" current may be determined beginning with a similar source density expression for the "magnetic" current. The results for "magnetic" and electric currents are then combined, according to the principle of superposition, to predict the fields produced by the structure of FIG. 2 at the distance R from the origin of the coordinate system. These fields are predicted by equation 3.

$$E_\phi{}^e = -\frac{\beta q a Z_o I_o}{2R}\cos n\phi J_n'(\beta g a \sin\theta)e^{j(\omega t - \beta_o R + \frac{n\pi}{2})} \quad (3a)$$

$$E_\theta{}^e = \frac{n\beta g a Z_o I_o}{2R}\sin n\phi \frac{J_n(\beta g a \sin\theta)}{\beta g a \tan\theta} e^{j(\omega t - \beta_o R + \frac{n\pi}{2})} \quad (3b)$$

$$E_\theta{}^m = -\frac{\beta g a I_m}{2R}\cos n\phi J_n'(\beta g a \sin\theta)e^{j(\omega t - \beta_o R + \frac{n\pi}{2})} \quad (3c)$$

$$E_\phi{}^m = -\frac{n\beta g a I_m}{2R}\sin\phi \frac{J_n(\beta g a \sin\theta)}{\beta g a \tan\theta} e^{j(\omega t - \beta_o R + \frac{n\pi}{2})} \quad (3d)$$

The superscript e indicates a field component attributable to the electric current, whereas the superscript m indicates a field component attributable to the "magnetic current". $\beta$ is the phase constant equal to $2\pi/\lambda$; $\beta_o$ is calculated with $\lambda$ equal to the free-space wavelength at the frequency of operation, $\lambda_o$, while $\beta_g$ is calculated using the guide wavelength, $\lambda_g$. $Z_o$ is the characteristic impedance of free space, $\omega=2\pi f$ and $J_n$ are the usual Bessel functions. The magnitude of the "magnetic current" is $$I_m = \omega\mu \frac{\pi b^2}{s} I_o,$$

where the new terms are $\mu$, the permeability of free space, and $I_o$, the magnitude of the electric current flowing in the conducting path. In the azimuthal, i.e., horizontal, plane, $\theta=90°$. When n=1, the fundamental resonance frequency, the magnitudes of the fields reduce to:

$$E\phi = -\frac{\beta_g a Z_o I_o}{ZR} J'_1(\beta g\ a)\cos\phi \quad (4a)$$

$$E\theta = -\frac{\beta_g a I m}{ZR} J'_1(\beta g\ a)\cos\phi \quad (4b)$$

Monofilar Toroidal Embodiments. Equation 2 may be used to design circular toroidal embodiments of the inventive structure. The simplest embodiments are referred to as monofilar since they have a single electrically conducting path.

a. Conceptual embodiment of a receiving antenna for FM broadcast. Assume a primary resonance frequency of 100 HMz, and the following parameters:

b=0.5 inches=1.27 cm.

s=0.5 inches=1.27 cm.

Applying equation 2, $V_f=0.296=\lambda_g/\lambda_o$, so that the major radius is a 14.1 cm.=5.55 inches. From Equations 4, it can be seen that azimuthal $\theta$ and $\phi$ fields of this antenna will vary and have different magnitude ratios in different directions. Therefore, this antenna has an elliptically polarized characteristic. The maximum dimension of this embodiment is 0.1 free-space wavelengths at the primary self-resonance frequency.

b. Conceptual embodiment of a low frequency (LF) antenna. Assume a primary resonance frequency of 150 kHz and let:

b=10 feet=3.05 m.

s=2 feet=0.61 m.

Solving equation 2, $V_f=0.053$, so that a=55.8 feet=17 m. Although this structure is physically large, its maximum dimension is only about 0.02 free-space wavelengths at the primary self-resonance frequency.

c. Measurement embodiment of a very high frequency (VHF) antenna. This embodiment of my invention was constructed on a plastic torus form as shown in FIG. 3 with the following parameters:

a=6.25 inches=15.87 cm.

b=0.5 inches=15.87 cm.

N=70 turns (of 16 gauge copper wire)

s=0.56 inches=1.42 cm.

Figure 6:
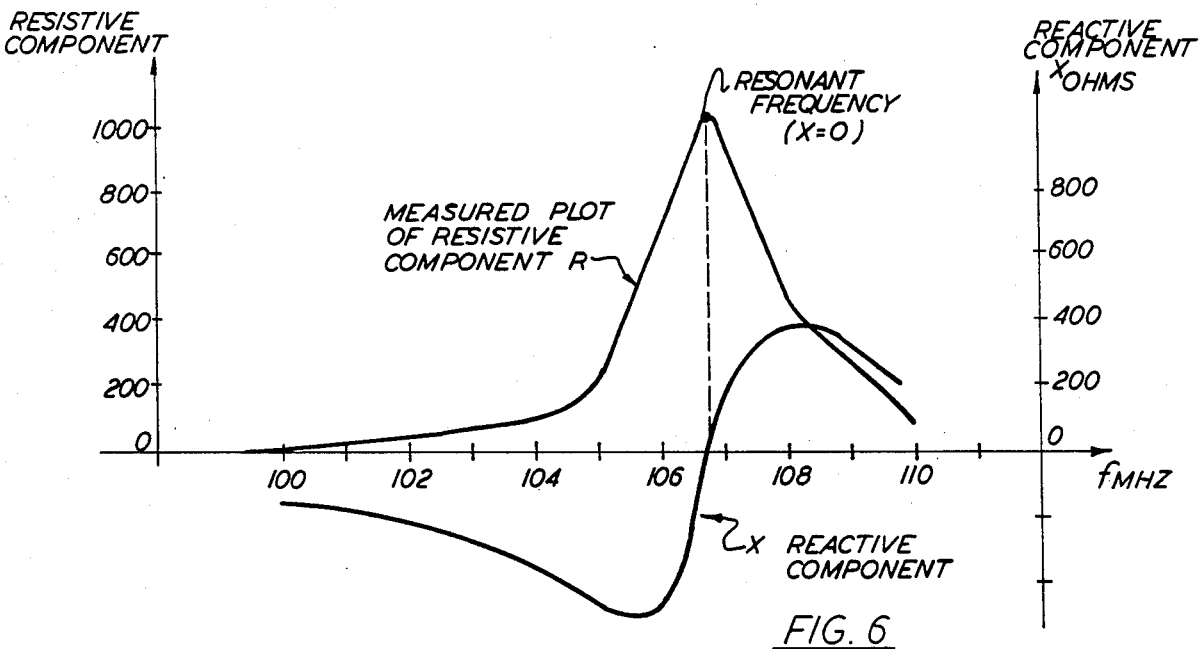
FIG. 6 shows the measured feed point impedance as a function of frequency of a very high frequency antenna constructed according to the embodiment of the invention depicted in FIG. 3.

According to Equation 2, the velocity factor at the primary resonance frequency of 100 MHz is 0.336. The measured value was 0.332 at a resonance frequency of about 106.8 MHz. A measured plot of the input impedance as a function of frequency of this embodiment is shown in FIG. 6. The resonance frequency, at which the reactive component of the impedance is zero, is readily identified. The measured characteristic shows a relatively narrow bandwidth and an input impedance at resonance of 1000 ohms. As with all embodiments of the invention, the zero reactive impedance component means that there is no need to use a matching component to attempt to achieve a conjugate match between the receiver or transmitter impedance and the antenna impedance in order to maximize system efficiency. The resistive components of the structures described here are readily matched in a receiver or transmitter by known circuit design techniques.

d. Measured embodiment of a high frequency (HF) antenna. This embodiment had the following parameters:

a=2.74 feet=0.834 m.

b=0.925 inches=2.35 cm.

N=1000 turns (of 18 gauge wire)

s=0.2 inches=0.5 cm.

Figure 7:
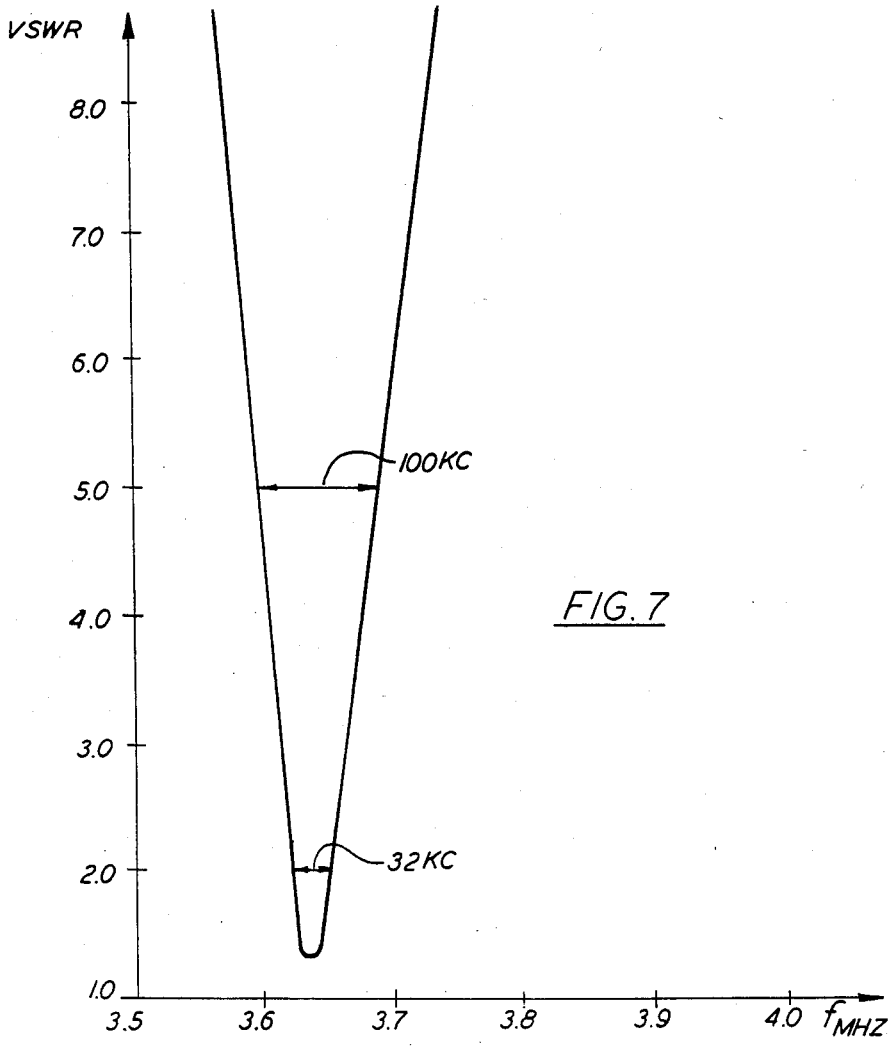
FIG. 7 shows the measured voltage standing wave ratio as a function of frequency measured in the vicinity of the primary resonance frequency of a high frequency antenna constructed according to the embodiment of the invention depicted in FIG. 2.
Figure 8:
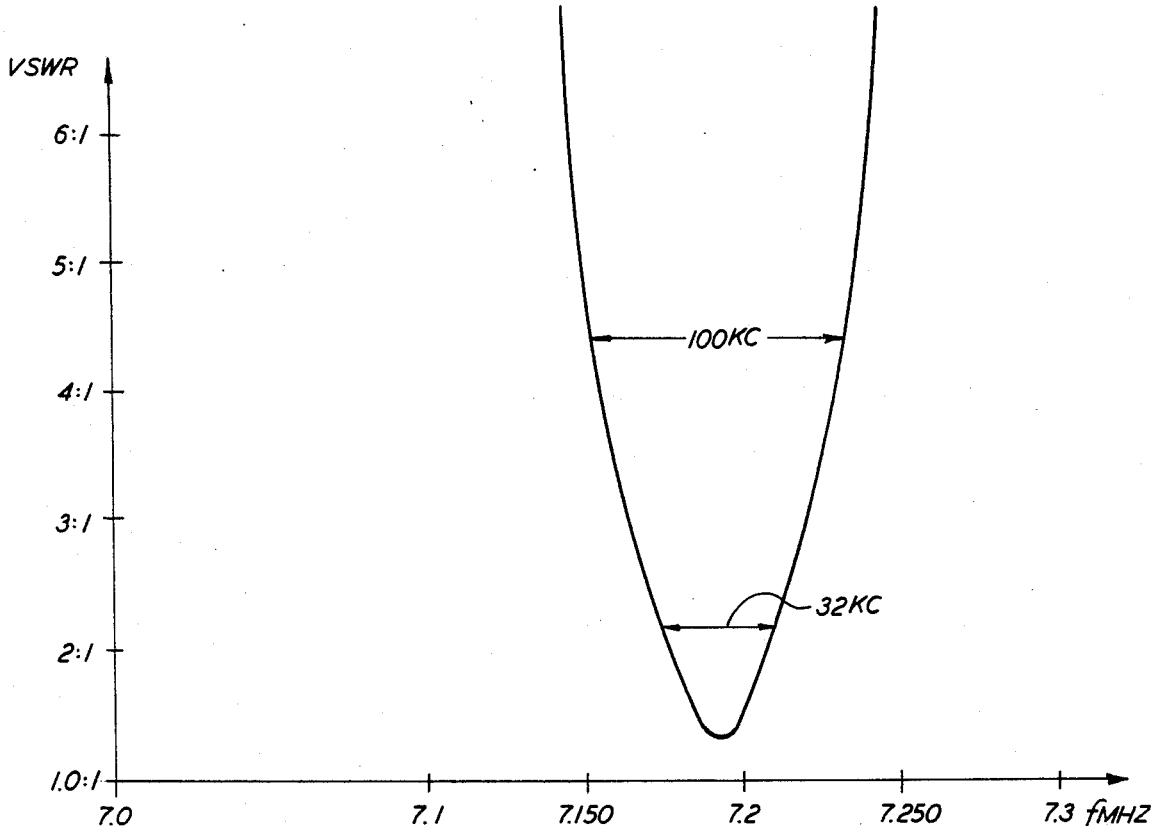
FIG. 8 shows the measured voltage standing wave ratio as a function of frequency measured in the vicinity of the secondary resonance frequency of a high frequency antenna constructed according to the embodiment of the invention depicted in FIG. 2.

The voltage standing wave ratio (VSWR) of this antenna was measured through a 4 to 1 balun transformer and a 50 ohm coaxial cable. In FIG. 7, the measured VSWR is plotted versus frequency in the vicinity of the primary resonant frequency, n=1, of about 3.63 MHz. In FIG. 8, the measured VSWR as a function of frequency is plotted in the vicinity of the secondary resonant frequency, n=2, of about 7.19 MHz. FIGS. 7 and 8 illustrate two important properties of embodiments of the invention. First, the various resonance frequencies of an embodiment of the invention do not have the familiar integer multiple, harmonic relationship of a simple linear antennas. The absence of this relationship is evident from the non-linear wavelength relationship of Equation 2. Second, although operation of this embodiment of the invention at higher modes increases its electrical size, it also broadens its bandwidth. This increase in electrical size is particularly useful at higher frequencies, where embodiments of the inventive antenna may be undesirably physically small if operated at their primary frequencies. The broadened bandwidth may be important at any frequency. In the present embodiment, at the primary resonant frequency, the maximum dimension is 0.01 free-space wavelengths and at the secondary resonant frequency the maximum dimension is 0.02 free-space wavelengths.

e. Measured embodiment of a medium frequency (MF) antenna. This embodiment had the following parameters:

a=12 feet=3.66 m.

b=9.7 feet=2.96 m.

N=120 turns

Figure 9:
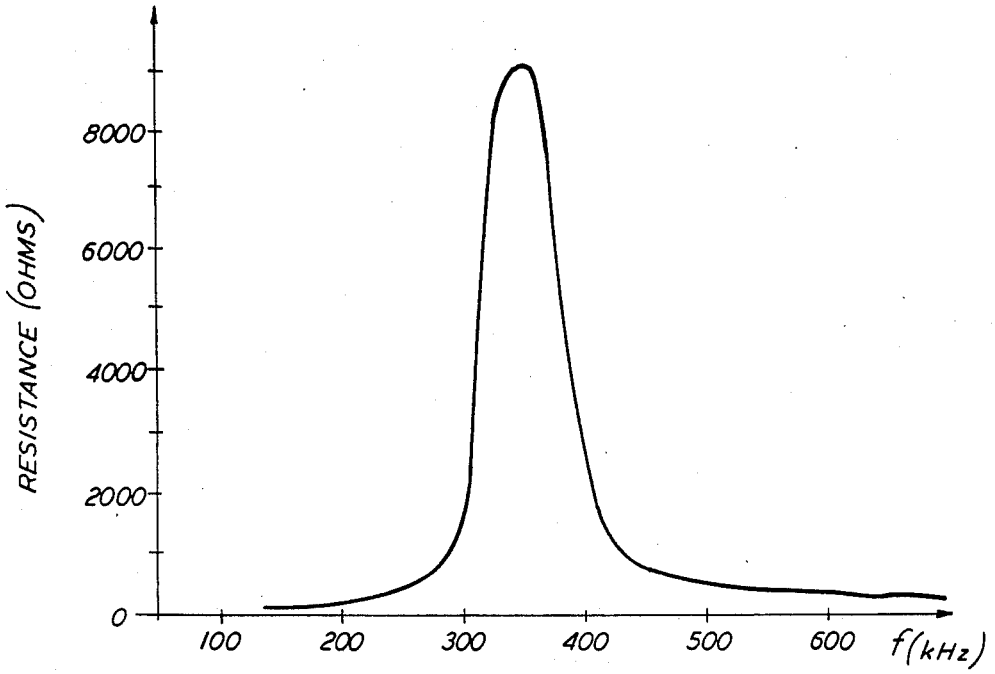
FIG. 9 shows the resistive component of the measured feed point impedance as a function of frequency of a medium frequency antenna constructed according to the embodiment of the invention depicted in FIG. 2.

The feed point impedance was measured with a General Radio 916-AL impedance bridge with the antenna placed four feet above sandy soil. As expected with the simple toroidal embodiment of the invention, elliptically polarized radiation was observed. A plot of the measured resistive component of the feed point impedance as a function of frequency is shown in FIG. 9. The resonant frequency was 339 kHz at an impedance of approximately 9100 ohms. At the measured resonant frequency, the maximum dimension of the antenna is about 0.015 free-space wavelengths.

The "crossed-field" properties of the toroidal embodiment of the invention are particularly useful in mobile communications typically operated in the VHF and UHF frequency ranges. The typical whip receiving antenna used in these applications responds to the electrical field component aligned with it. In metropolitan areas, particularly, a communications transmitter located between buildings, fences or the like, produces standing electrical and magnetic wave components that are spatially displaced by one quarter wavelength with respect to each other. Therefore, the amplitude of the received signal at the antenna terminals varies depending upon the location of the antenna, much like the response of a waveguide probe moving along a slotted waveguide supporting a standing wave. The same result is obtained regardless of whether an antenna sensitive to the electrical or magnetic components of the wave is used.

Because the toroidal embodiment of the inventive antenna, particularly, responds to both electrical and magnetic components of an electromagnetic wave, it can be used to avoid these standing wave effects. Therefore, this embodiment could be referred to as an energy antenna since it responds to the energy in the transmitted wave rather than to one of the components of the transmitted wave. In addition, as shown by Equations 3 and the discussion that follows, embodiments of the inventive structure may be designed to maximize response to electrical or magnetic field components to take advantage of the phenomenon of transmitted standing waves.

Figure 10:
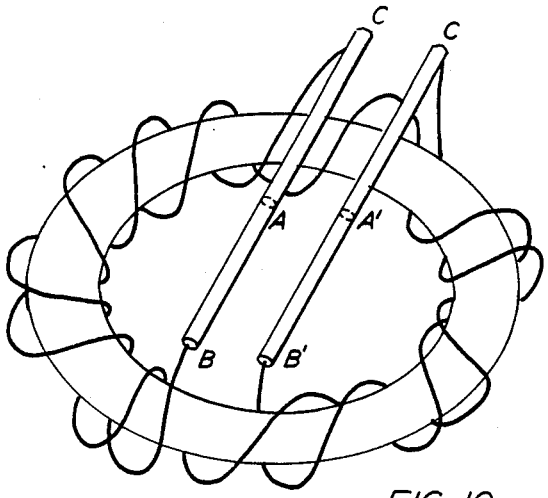
FIG. 10 shows a perspective view of an embodiment of an electromagnetic structure according to the invention including bifilar electrically conducting paths.

Multifilar Toroidal Embodiments. By combining the fields of Equations 4, various azimuthal radiation patterns can be generated. The physical achievement of the combinations is made by using several helical conducting paths on a multiply connected, endless tube or toroidal form and establishing a fixed phase relationship between the currents in each helical conducting path. These embodiments of the invention are referred to as multifilar since they have multiple electrical conducting paths. An embodiment of a bifilar structure employing the special case of a multiply connected or endless tube surface called a toroid and used as an antenna is shown in FIG. 10. The bars BC and B'C are phasing lines for controlling the relative phases of the current in each path and provide input terminals for the feed. One conducting path runs from B to B' and the other from C to C'. The paths do not intersect since they are wound with the same sense and pitch. When the windings are fed at terminals AA', in the middle of the phasing bars, the currents flow in opposite directions in the windings and the field produced by one of the electric current loops is reversed with respect to the other. Therefore, the $E_\phi$ components, from Equation 4a, of the two windings are 180° out of phase and cancel. As a result, a vertically polarized field in the horizontal plane is produced. The antenna pattern has a "figure 8" shape. If B and B' or C and C' are interchanged, reversing the current in one winding with respect to the other in comparison to the previous embodiment, then the $E_\theta$ components, from Equation 4a, of the two windings cancel and a horizontally polarized field with the same antenna pattern before is produced.

a. Measured embodiment of a bifilar VHF antenna. A bifilar antenna such as shown in FIG. 10 and driven at terminals AA' to produce vertically polarized radiation had the following parameters:

a=12.5 inches=31.75 cm.
b=0.5 inches=1.27 cm.
s=0.26 inches=0.63 cm.

The observed radiation was predominantly vertical; the vertical to horizontal field strength ratio was 46. The velocity factor calculated from Equation 2 was 0.153 compared to a measured value of 0.156 at 46 MHz. A "figure 8" radiation pattern was observed. At the resonant frequency, this embodiment is about 0.1 free-space wavelengths across.

b. Measured embodiment of a bifilar MF antenna. This bifilar antenna had the following parameters:

a=5.95 feet=1.81 m.
b=0.95 feet=29.0 cm.
s=4 inches=10.2 cm.
N=106 turns (of ⅜" copper tubing)

Figure 11:
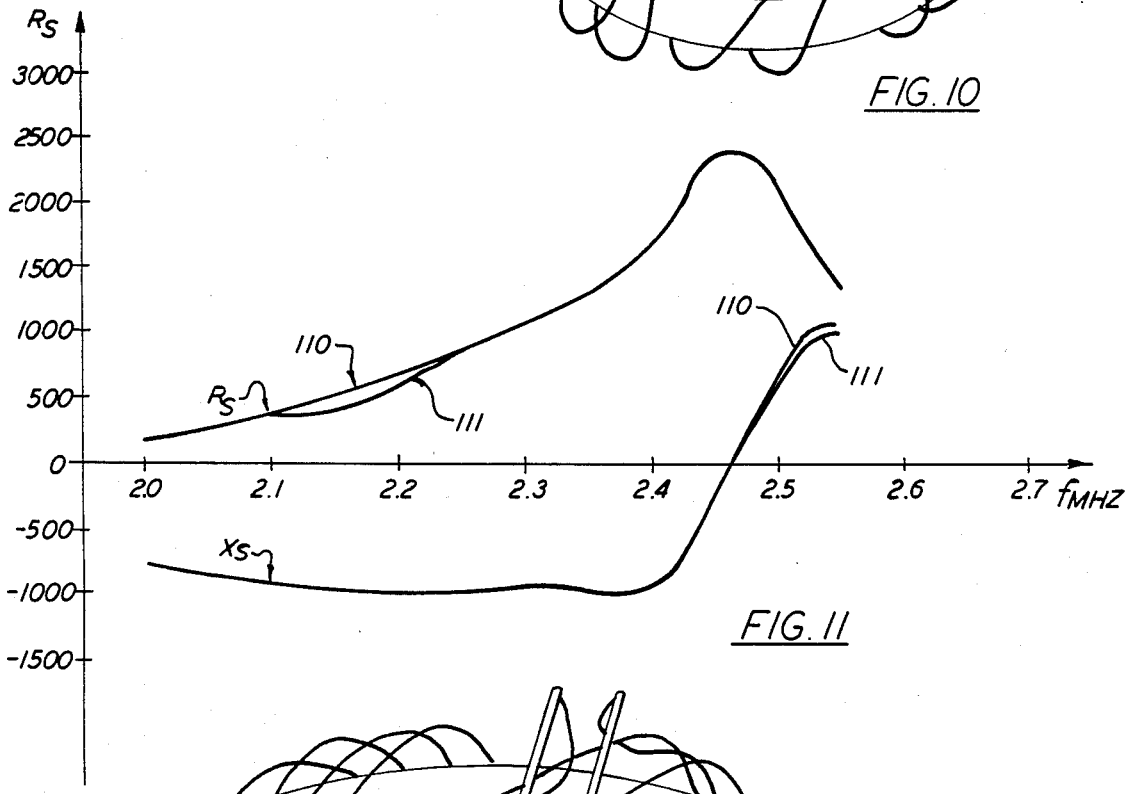
FIG. 11 shows the measured impedance as a function of frequency of a medium frequency antenna constructed according to the embodiment of the invention depicted in FIG. 10.

The structure was placed 3.5 feet above soil having a measured conductivity of 2 millimhos/meter. The structure was fed and the impedance measured at points AA' of FIG. 10. The measured results are plotted in FIG. 11 as a function of frequency. The calculated velocity factor was 0.103 while the measured value was 0.094 at about 2.46 MHz. The larger variation between the calculated and measured velocity factor in this embodiment compared with other measured embodiments may be attributable to mutual coupling effects of the conducting paths. In order to determine the magnitude of the effects, if any, of the earth on the antenna, 40 twenty foot long conducting rods were disposed radially and symmetrically on the ground beneath the antenna. The feed point impedance shifted very little, from the lines marked 110 in FIG. 11 to the lines marked 111. The small change suggest the major fields are produced by the "magnetic current." This embodiment, at its primary resonance, had a maximum dimension of 0.03 free-space wavelengths.

Figure 12B:
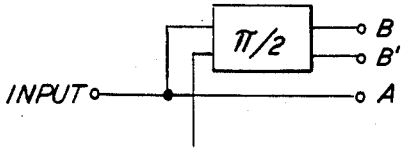
FIG. 12*b* shows, schematically, a phase shifting network for use with the electromagnetic structure of FIG. 12*a*.
Figure 12A:
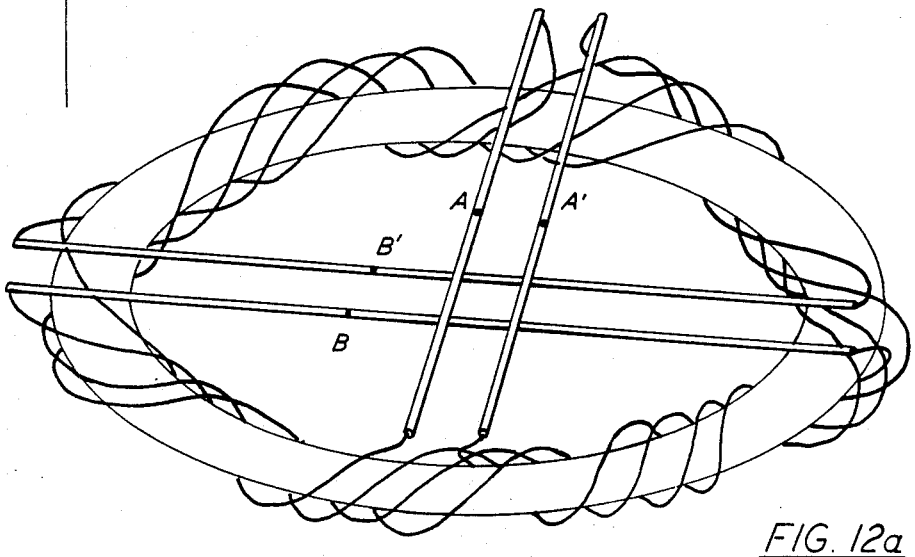
FIG. 12*a* shows a perspective view of an embodiment of an electromagnetic structure according to the invention including quadrifilar electrically conducting paths.

If two of the embodiments of FIG. 10 are combined to form a quadrafilar embodiment as in FIG. 12(*a*) with their two pairs of windings fed in quadrature, as indicated by the phasing means shown in FIG. 12(*b*), an omnidirectional antenna pattern may be produced. Both pairs of windings in the quadrafilar embodiment are arranged to produce vertical polarization; that is, their $E_\phi$ field components are cancelled, leaving an $E_\theta$ component proportional to $\sin \omega t \sin \phi + \cos \phi \sin \omega t = \sin(\phi + \omega t)$. Because of the phase relationship of the fields produced by the two pairs of conducting paths, the "figure 8" radiation pattern of the quadrafilar embodiment rotates at a rate equal to the frequency of operation, yielding an effectively omnidirectional azimuthal pattern. This is the same pattern produced by the turnstile antenna, Brown, "The Turnstile Antenna," *Electronics* (April 1936) 14, but produced in a different way. I have found experimentally that operation of this embodiment at its higher order modes results in increasing the horizontally radiated field at the expense of vertically radiated field. This embodiment offers particular promise for standard AM broadcast transmission in which the customary very tall, vertical transmitting antenna tower may be eliminated with no loss of, or even an increase in, the field strength at receiving locations.

By interchanging the path connections at one end of each pair of bars, a similar omnidirectional rotating radiation pattern may be achieved, but with horizontal polarization. This result is entirely analogous to that previously described for the structures of FIG. 10. Other polarization mixtures may be obtained by varying the phase relationships of the feeds and currents and a great variety of desirable radiation phenomena produced.

c. Measured embodiment of a quadrifilar omnidirectional VHF antenna. A quadrifilar antenna of the construction shown in FIG. 12 was constructed on a plastic torus with the following parameters:

a=4 inches=10.2 cm.
b=0.3 inches=0.76 cm.
s=0.4 inches=1.02 cm.
N=64 turns

The structure had a primary resonance frequency of 93.4 MHz and the ratio of vertically polarized to horizontally polarized field strengths was 76.4. The antenna spanned 0.07 free-space wavelengths at the primary resonant frequency.

All of the multifilar embodiments shown and discussed had toroidal, helical paths of the same sense and pitch so that the paths do not cross. As used here, the term multifilar means having more than one conducting path, regardless of whether or not the paths intersect.

Figure 13:
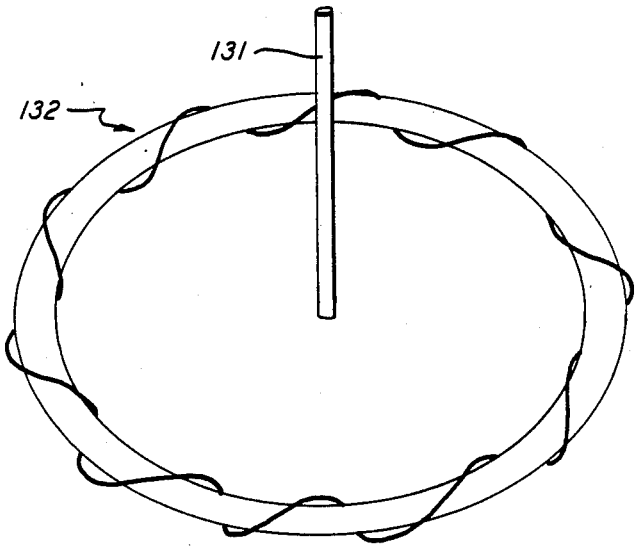
FIG. 13 shows a perspective view of an embodiment of an electromagnetic structure according to the invention.

Antenna Array Embodiments. Antenna arrays employing driven and parasitic elements to produce directed radiation patterns are known in the art. Inventive arrays incorporating the advantages of my invention may be constructed. In FIG. 13, a driven linear element 131 excites a parasitic toroidal element 132. More complex arrays may be constructed using additional toroidal elements appropriately physically spaced and having currents phased to increase the directivity of the radiation pattern or to generate different radiation patterns. Known or novel phased array techniques may also be employed.

a. Measured embodiment of VHF array antenna. A VHF array antenna as shown in FIG. 13 was constructed. Element 131 was a quarter wavelength stub, at 450 MHz, disposed above a ground plane two free space wavelengths in diameter. Element 132 was a toroidal loop having a major radius of approximately one tenth of a free-space wavelength (approximately 2⅝ inches) and tuned to resonate at about 495 MHz. The maximum measured gain was 4 dB over that of the linear element alone.

Figure 14:
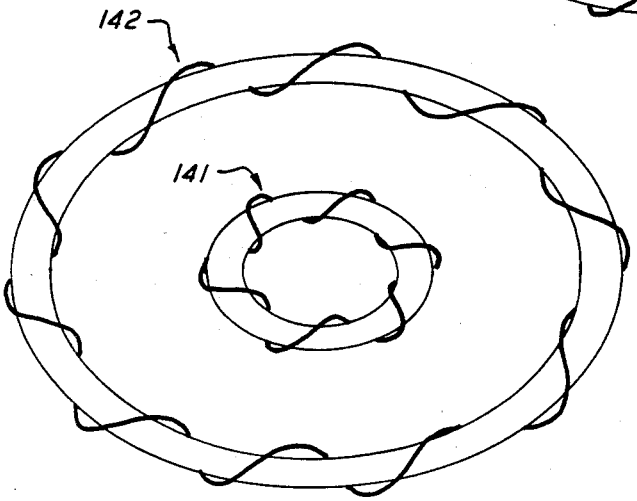
FIG. 14 shows a perspective view of an embodiment of an electromagnetic structure according to the invention.

In FIG. 14 another array according to the invention is shown. In that array a toroidal element 141 is resonant at the transmitting frequency. A toroidal element 142 is tuned as a parasitic director at a frequency about 10 percent above that of the resonant frequency of element 141. Element 142 has a diameter about one tenth of a free-space wavelength larger than the diameter of element 141.

Figure 15:
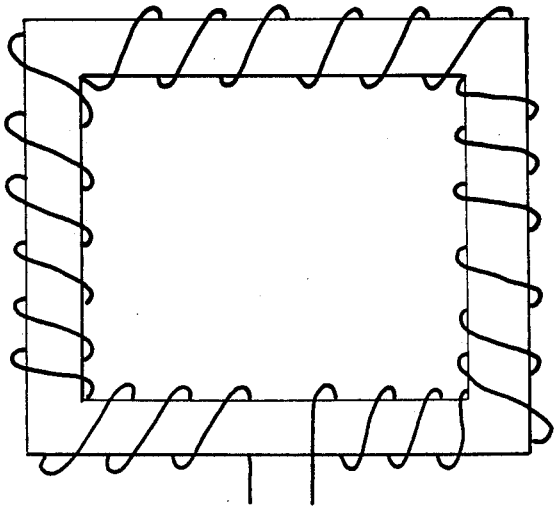
FIG. 15 shows a top view of an embodiment of an electromagnetic structure according to the invention having a rectangular form.
Figure 16:
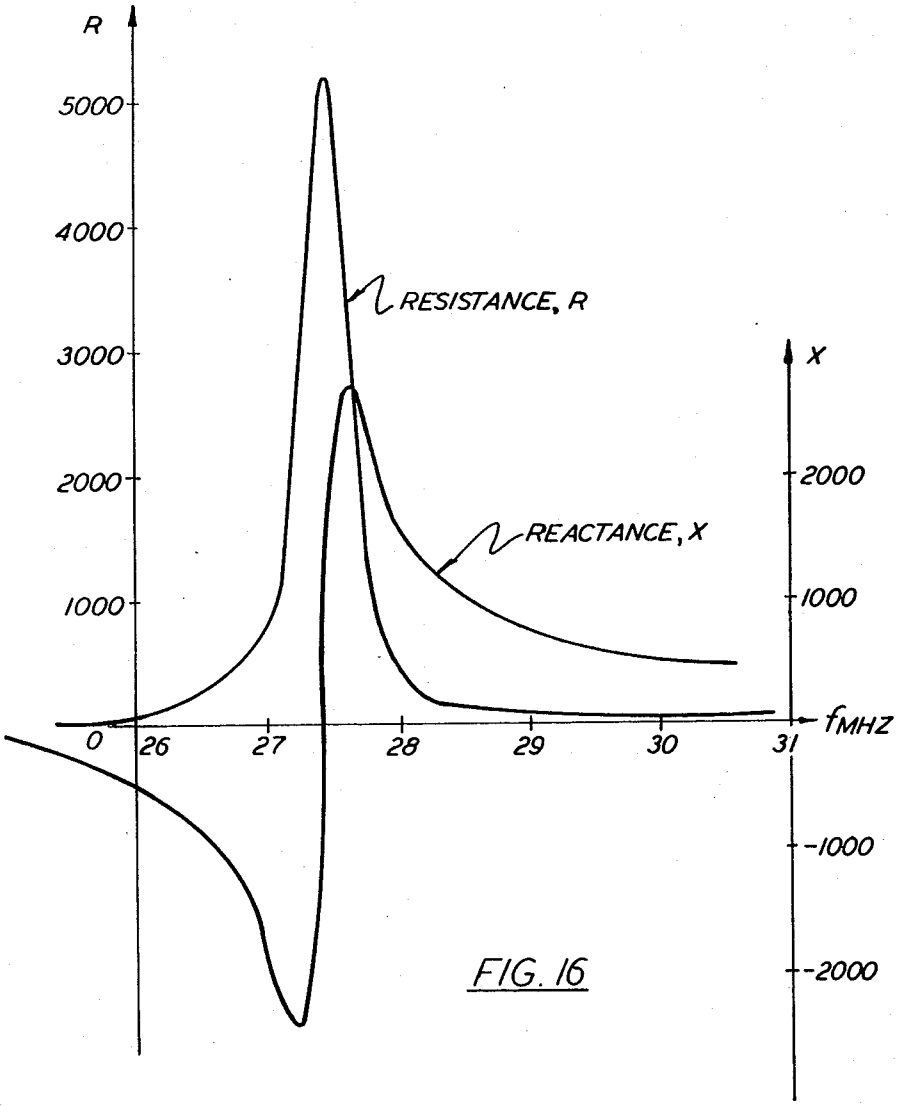
FIG. 16 shows the measured feed point impedance as a function of frequency of a high frequency antenna constructed according to the embodiment of the invention depicted in FIG. 15.

Non-toroidal Embodiments of The Invention. As already mentioned, the surface (real or imaginary) on which the conducting path for creating slow waves is disposed need not be toroidal. In fact, it may not be a real surface at all. But it is convenient to construct mentally a mathematical surface on which the conducting path is disposed for purposes of describing the inventive structure. A toroidal surface is a surface of rotation, but may for example, include corners. I have constructed toroidal embodiments of my invention having rectangular and triangular cross sections. Other closed tube-like, but non-toroidal surfaces, can also provide forms for constructing embodiments of my invention. Virtually any multiply connected surface, as that term is used in the mathematical specialty of topology, may be used as a form upon which a conducting path may be disposed to construct an embodiment of my invention. As used generally and herein, the term multiply connected surface, includes toroidal surfaces and the particular toroidal surface referred to as a torus, as well as far more complex surfaces. Multiply connected surfaces also include the outside surface of an endless tube. A tube may have any arbitrary cross sectional perimeter and area. For example, a cross sectional perimeter of a tube may described a circle, an ellipse, a more complex cornerless figure, a triangle, a rectangle, a more complex polygon, or even a combination of straight and curved lines. The cross sectional perimeter and/or area can vary along the length of the tube. When such a tube is formed linearly, with two ends, and the ends are brought together and joined, the outside surface of an endless tube is formed. This class of multiply connected surfaces, which includes the outside surface of a torus, may also be used as forms for embodiments of my novel antenna as the next example illustrates. That is, electromagnetic structures within the scope of my invention are not limited in form to toruses or even to more general toroidal forms.

a. Measured non-toroidal embodiment of an HF antenna. An HF antenna was constructed on a form having a rectangular shape as shown in the top view of FIG. 15. The form was prepared from plastic pipe having a circular cross section and a 2½ inch outside diameter. The rectangle was a square 27 inches on a side with its feedpoint at the center of one of the legs. The conductive path was constructed from 116 equally spaced turns of 18 gauge copper wire. The measured feedpoint impedance of this structure is plotted in FIG. 16 as a function of frequency and shows a resonance at 27.42 MHz.

Figure 17:
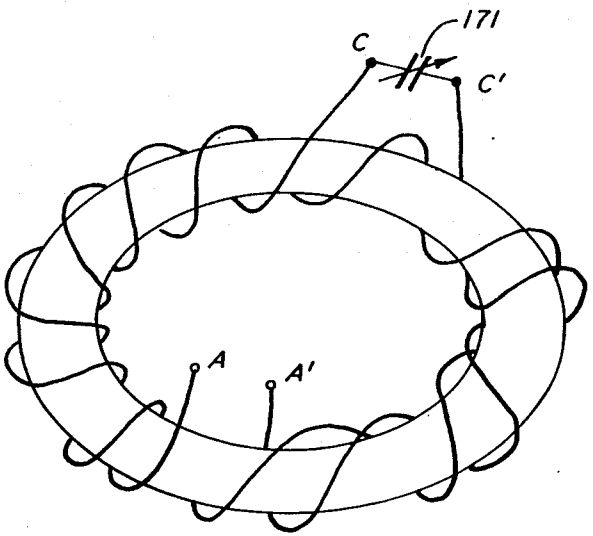
FIG. 17 is a perspective view of an embodiment of an electromagnetic structure according to the invention including a frequency adjustment means.

Frequency Tuneable Embodiment. A characteristic of the measured results presented above for various embodiments of the inventive structure is a relatively high Q at the fixed resonance frequencies of each structure. In FIG. 17 an embodiment of a structure according to the invention is shown including a continuous monofilar conducting path and a shorter, discontinuous interleaved conductor. The shorter conductor has the same sense as the continuous conductor on the toroidal form. One path ends in the feed terminal A, A'. A variable reactance, capacitor 171, is connected across the terminals C, C' of the other path. By varying the capacity of capacitor 171, the resonant frequency of the structure may be adjusted. Similarly, a variable inductance may be used to tune the resonant frequency of the structure.

Figure 18A:
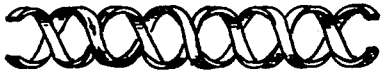
FIG. 18*a* is a perspective view of a prior art contrawound helix.
Figure 18B:
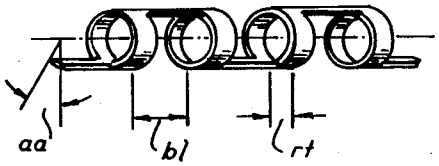
FIG. 18b Prior Art
FIG. 18*b* is a perspective view of a prior art structure electrically equivalent to the contrawound helix of FIG. 18*a*.
Figure 19A:
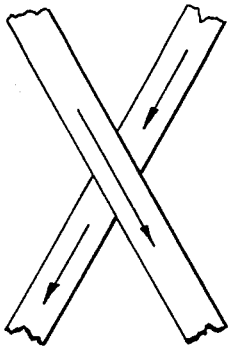
Figure 19B:
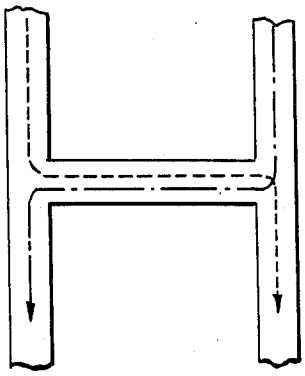
* and FIG. 19*b* is a view of the current crossover paths of the electrically equivalent structure of FIG. 18*b*.
Figure 26:
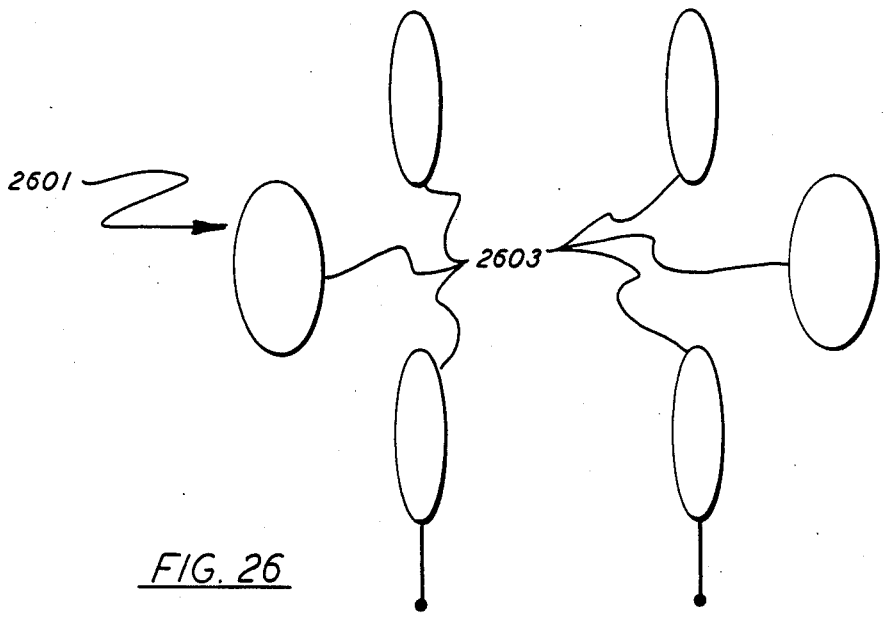
FIG. 26 is a perspective view of an embodiment of an electromagnetic structure according to the invention.

Contrawound Embodiments. Certain specialized forms of multifilar helical embodiments of the inventive structure achieve extremely important results. All of the multifilar embodiments previously discussed have toroidal helical conducting paths having the same sense and pitch. In those embodiments the conducting paths do not cross each other. By contrast, when two or more helical paths on a toroidal form have opposite senses, the paths repeatedly cross. Structures with multiple paths having opposite senses or its electrical equivalent are referred to here as being contrawound. Contrawound helices, such as shown in FIG. 18(*a*), and related structures, such as the ring and bridge structure shown in FIG. 18(*b*), have been used as slow wave structures in microwave tubes. See, Birdsall et al., "Modified Contrawound Helix Circuits for High Power Traveling Wave Tubes," ED-3, *I.R.E. Trans. on Electron Devices,* 190 (1956). These contrawound slow wave structures may be conceptually bent into a closed, toroidal form to produce embodiments of my inventive structure. In the structure resulting from "bending" of the structure of FIG. 18(*b*), the "bridges" are aligned with the circle described by the major radius of the torus and the "rings" are transverse to that circle. Both the bridges and rings lie on the same toroidal surface. The current flows at the crossovers of electrical paths of the slow wave structures shown in FIG. 18(*a*) and 18(*b*) are shown in FIGS. 19(*a*) and 19(*b*), respectively. An important feature of the ring and bridge structure of FIG. 18(*b*) is shown in FIG. 19(*b*). In that structure, since the currents of the waves propagating in opposite directions on the structure are constrained to flow in opposite directions along the "bridges", i.e., at the crossover paths, if those counterflowing currents are equal they cancel each other. For an inventive toroidal structure employing the slow wave conducting path of FIG. 18(*b*), the crossover cancellation means that, effectively, the only net electric current flowing in the structure flows around the rings lying transverse to the circle described by the major radius of the torus. That is, no net electric current flows along the circle described by the major radius of the torus. The electric current that does flow in the structure, sometimes referred to as a poloidal flow, in contrast to the cancelled toroidal flow, is equivalent to a toroidal "magnetic current" flow. Since no net toroidal electric current flows, the conducting bridges are unnecessary to this mode of operation of the toroidal ring and bridge structure embodiment of the invention. In fact, such an embodiment may be readily constructed by omitting the bridges and allowing the ring widths to be so narrow that the rings are no more than loops of wire disposed on a multiply connected surface. A view of an embodiment 2601 of such a structure is shown in FIG. 26 where wire loops 2603 are disposed on toroidal surface. Applying Equations 3 to this mode of operation of the ring and bridge embodiment and its equivalents, $I_o=0$ and $\alpha=(\pi/2)$ so that the $E_\phi^e$ and $E_\theta^e$ equations equal zero. The $E_\phi^m$ and $E_\theta^m$ equations remaining predict that elliptically polarized fields will be produced by this structure.

a. Measured embodiment of contrawound antenna. A contrawound toroidal structure of the form shown in FIG. 18(*b*) was constructed with the following dimensions as defined in that figure.

ring thickness (rt)=0.5 inches=1.27 cm.

bridge length (bl)=0.25 inches=0.63 cm. N=78 turns.

The resulting structure performed as an antenna with a resonance at 85 MHz and a radiation resistance of about 300 ohms.

It is particularly desirable to construct an antenna according to the invention producing only vertically polarized radiation and having an omnidirectional radiation pattern in the azimuthal plane. Such a pattern is produced by a loop of continuous "magnetic current" uniform in amplitude and phase, or its equivalent. With respect to Equations 3, the desired operation would correspond to operation of the contrawound structure just described with $E_\phi^m$ equal to zero, i.e., with n effectively equal to zero.

The known cloverleaf antenna employs, effectively, a uniform loop of electric current to produce a horizontally polarized field that is omnidirectional in the azimuthal plane. Smith, "Cloverleaf Antenna For FM Broadcasting," 35 *Proc. I.R.E.* 1556 (1947). The cloverleaf antenna succeeds in approximating a current flow uniform in phase and amplitude around a large loop through use of four radiators each bent into a smaller loop occupying a quadrant of a large, imaginary loop. The radiators are connected in parallel to achieve, effectively, the desired current flow.

Figure 20:
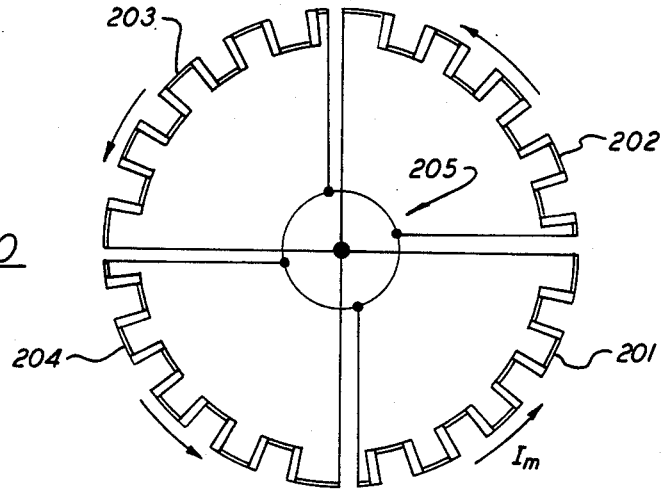
FIG. 20 is a top view of an embodiment of an electromagnetic structure according to the invention including a modified form of the structure of FIG. 18(*b*).

An embodiment of the inventive structure, in this case a magnetic analog of Smith's cloverleaf antenna, is shown in top view in FIG. 20. There, the "ring and bridge" slow wave structure of FIG. 18(*b*) has been bent into a circle and the structure divided into four opposing portions each occupying a quadrant—201, 202, 203 and 204. Each of the quadrants is connected in parallel across a coaxial feed 205 so that a "magnetic feed current" simultaneously flows in the same direction in each quadrant and, thereby, around the circle. This embodiment of the structure acts as an antenna with a uniform "magnetic current" loop, thereby producing vertical polarization in an omnidirectional radiation pattern. That is, n in Equations 3 is effectively equal to zero. Only Equation 3(c) has a non-zero value for the electromagnetic fields produced by this embodiment.

b. Measured embodiment of VHF antenna producing vertically polarized, omnidirectional radiation. An embodiment of the antenna shown in the top view of FIG. 20 was constructed. The slow wave structure was fabricated from 32 turns of 10 gauge copper wire. The major radius was $4\frac{3}{4}$ inches and the minor radius was 11/16 inches. The bridge length ("bl" of FIG. 18) was $\frac{3}{4}$ inches and the ring thickness ("rt" of FIG. 18) was $\frac{1}{8}$ inches. The structure was electrically, but not physically, divided into four quadrants which were fed in parallel from a coaxial line. The resonant frequency of the structure, operating as an antenna, was 125 MHz, and the radiation produced was vertically polarized and omnidirectional.

The contrawound embodiments of the novel antenna just described and the image plane embodiments about to be described are all toroidal. The is, the conductors are all disposed on the outside surface of an endless tube that, in these cases for simplicity of construction and mathematical analysis, is of uniform circular cross section and is arranged in a circle. Non-toroidal contrawound embodiments of my invention, with and without image means, also formed on the outside surface of an endless tube, can be built.

Image Embodiments. It is well known in the electromagnetic arts that the fields produced by an electric current above a perfectly conducting plane are the same as if an equal, oppositely directed current were flowing in mirror image on the opposite side of the plane and the plane were absent. In this principle, an image current flows along an image path. If the physically existing path is in electrical contact with the image plane, an electrically conducting circuit is completed—partly by the existing path and partly by the image path. This principle can be advantageously applied to construct many additional embodiments of my inventive structures. Other embodiments are "sliced," preferably in half along a plane of symmetry, such as an equatorial plane, removing the conducting path on one side of the plane and replacing it with the electromagnetic equivalent of a perfectly conducting plane. It is known in the art that such an image plane need not be a solid conductor, but that a screen or a set of wires disposed so that the spaces between them are much less than a wavelength will suffice.

Figure 21:
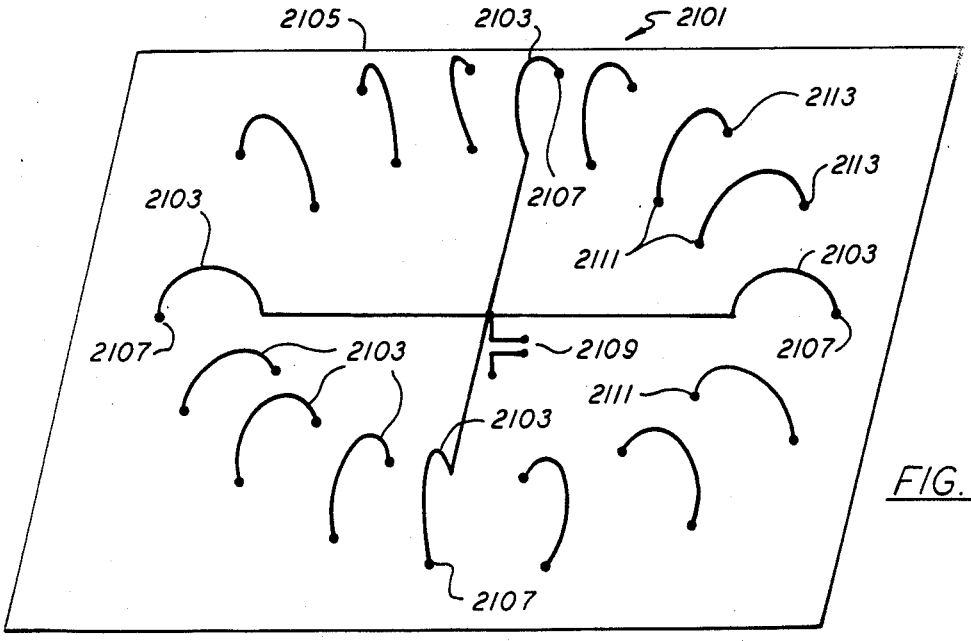
FIG. 21 is a perspective view of an embodiment of an electromagnetic structure according to the invention including an electrically conducting surface as an image path means.
Figure 22:
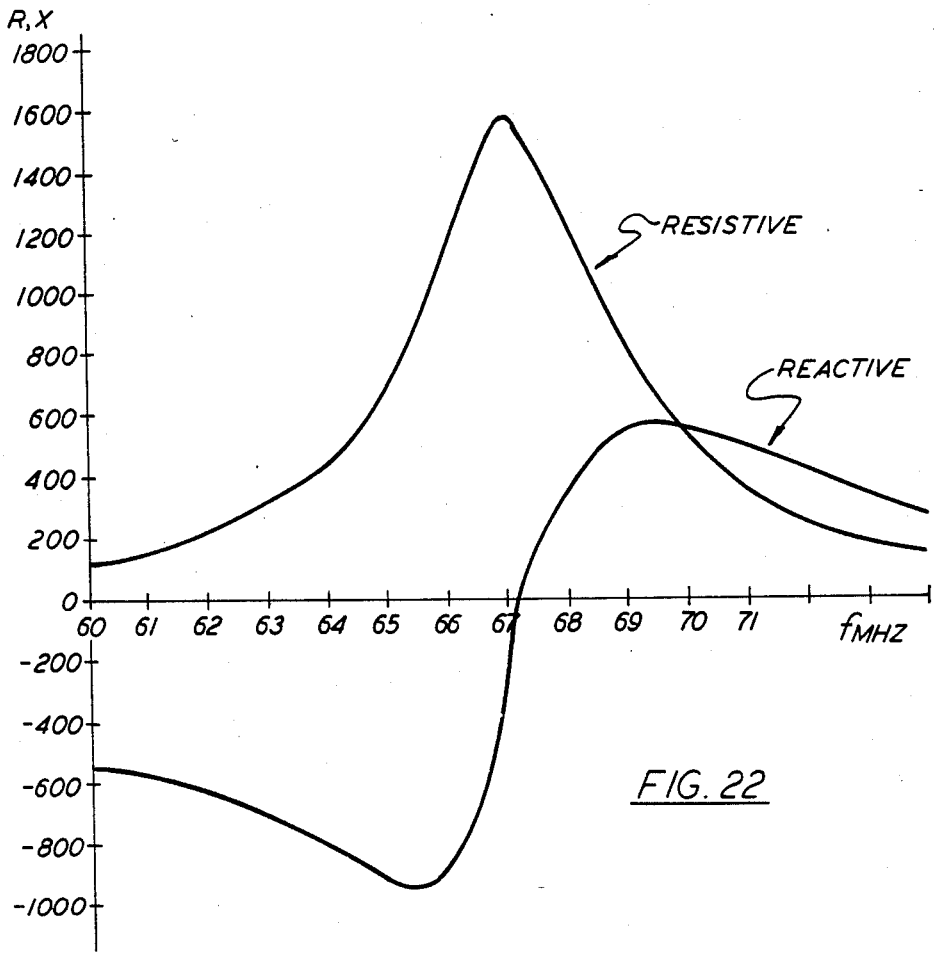
FIG. 22 shows the measured feed point impedance as a function of frequency of a very high frequency antenna constructed according to the embodiment of the invention depicted in FIG. 21.

In FIG. 21 an embodiment of a structure electromagnetically equivalent to that shown in FIG. 20 is depicted. The structure 2101 includes a plurality of conducting half circles 2103 each lying in a plane. All of the planes containing a half circle 2103 commonly intersect along a line which forms the Z axis of the embodiment. The missing portion of each conducting half circle or ring is replaced by an electrically conducting planar sheet 2105. Sheet 2105 may be a piece of copper or some other highly conducting metal. Half circles 2103 are disposed in a circle on sheet 2105. Four of half circles 2103, which are equally spaced from each other around the circle, have their outer ends 2107 electrically connected to sheet 2105. The inner ends of those four half circles are connected together at the Z axis of the embodiment to form one feed terminal 2109. Sheet 2105 is the other feed terminal. All of other half circles 2103 are equally spaced from each other around the circle described on sheet 2105. Other than the four feed point half circles, each half circle has each of its ends 2111 and 2113 electrically connected to sheet 2105. The image currents electrically complete each of the half circles 2103. In addition, sheet 2105 furnishes bridge connections between loops. Therefore, the embodiment of FIG. 21 is equivalent to the bridge and ring contrawound embodiment of FIG. 20 with narrow ring widths.

a. Measured embodiment of a VHF contrawound image antenna. I constructed an antenna embodiment of the type shown in FIG. 21 having a solid copper image plane and 32 half circles, each having a 2 inch (5.1 cm) diameter. The centers of the half circles were disposed on a 12 inch diameter circle. The measured feedpoint impedance of the structure is plotted in FIG. 22 and shows a resonance at 67.25 MHz at a resistance of nearly 1600 ohms. A coaxial line was used to feed the antenna. The polarization of the radiation was vertical and the radiation had a maximum value in the azimuthal plane.

Figure 23:
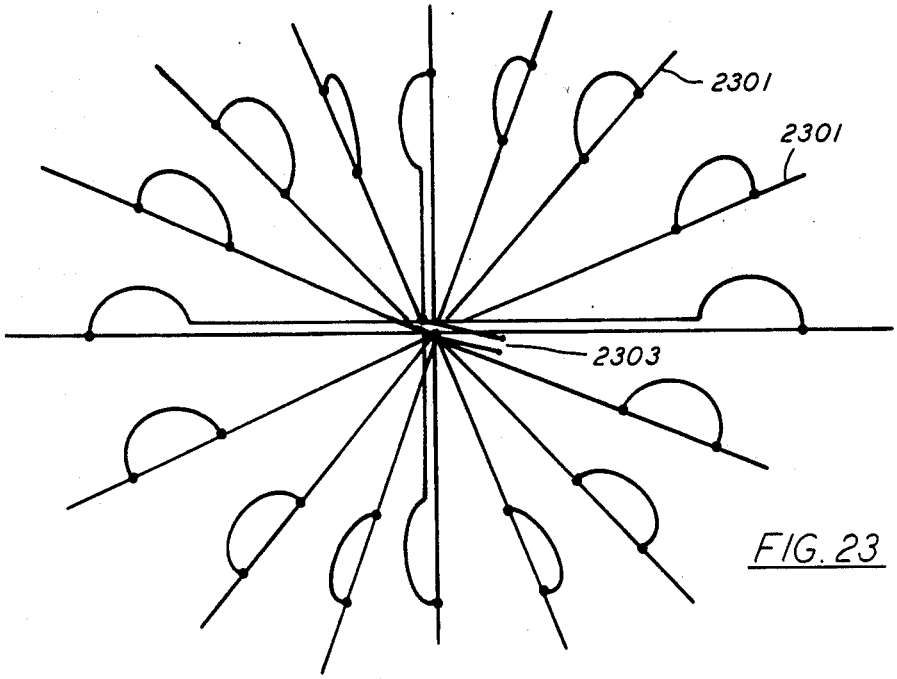
FIG. 23 is a perspective view of an embodiment of an electromagnetic structure according to the invention including electrically conducting radial wires as an image charge means.
Figure 24:
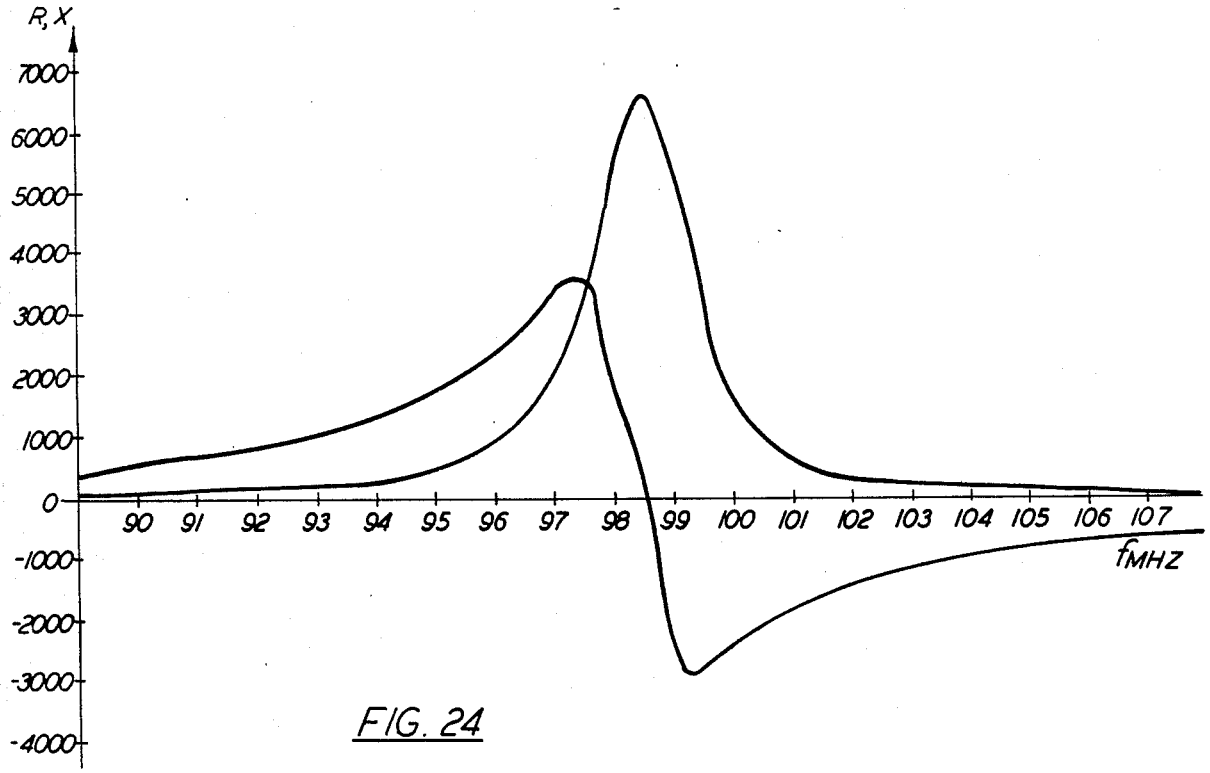
FIG. 24 shows the measured feed point impedance as a function of frequency of a very high frequency antenna cnstructed according to the embodiment of the invention depicted in FIG. 23.

In FIG. 23, an embodiment identical to that of FIG. 21 is shown, except that the solid conducting sheet has been replaced by radial conducting wires 2301. The spacing of those radial wires must be much less than a free space wavelength in order that the electromagnetic equivalent of a solid sheet is achieved. In general, because the inventive antenna embodiments are much smaller than a free space wavelength at the primary resonance frequency, conducting radial wires may nearly always be substituted in the embodiment for a solid image plane. I have found it useful to cut each of the radials 2301 to a length of one quarter of a free space wavelength at the operating frequency so that the image plane formed by the radials spans a half wavelength. This practice follows that used for minimum dimensioning of horizontal linear reflector elements used as a ground plane with vertical whip antennas. In FIG. 23 an embodiment of an antenna similar to that of FIGS. 20 and 21 is shown with four quadrant sections of the slow wave structures connected in parallel to a feed point 2303. The embodiment of FIG. 23 lacks the bridge elements of the bridge and ring structure. However, as already described for the embodiment of FIG. 26, which does not include an image path, and as confirmed by experiment for an embodiment including an image path, those "bridgeless" structures still behave as if they were contrawound, bridge and ring toroidal embodiments operated so that there is no net toroidal electric current flow.

b. Measured embodiment of a VHF antenna having image radials. An antenna embodiment like that shown in FIG. 23 was constructed. The embodiment had 32 half circles, each half circle having a diameter of 2 inches. The major radius of the "torus" was 10 inches. The four quadrants were fed in parallel through a short coaxial transmission line. The measured feedpoint impedance is plotted in FIG. 24 versus frequency and indicates a resonance at 98.5 MHz with a resistive impedance of about 6500 ohms. The structure produced vertically polarized radiation with a maximum in the XY plane and a minimum along the Z axis.

Figure 25:
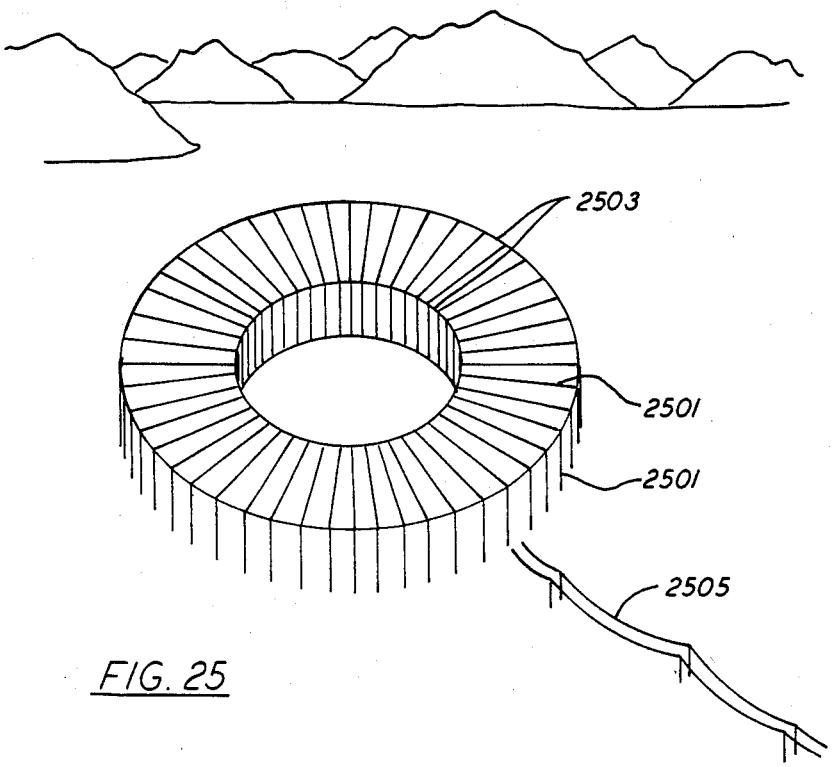
FIG. 25 is a perspective view of an embodiment of an electromagnetic structure according to the invention including the earth as an image path means.

The earth may also be used as an image plane. Antenna embodiments of my invention generally grow physically larger (though electrically smaller) for descending frequencies. In the larger embodiments effects of the earth are important and unavoidable, so it is advantageous to use the earth as an image source. Such an embodiment is shown in FIG. 25. There, a very large "toroidal" embodiment of the invention has conducting paths 2501 that are rectangular in cross section supported on dielectric circular forms 2503. The ends of each "half loop" are in electrical contact with the earth. A transmission line 2505 feeds the antenna. This structure behaves like a contrawound structure since it has a series of "rings" joined by earthen "bridges." In this embodiment, the rings are again narrow, are made complete rings by the image path and do not have a circular cross section, but a "ring and bridge" slow wave structure is still realized. It may even be desirable that the physical portions of the rings be greater or lesser than one-half the total effective ring cross section depending on the application. For example, when the earth provides the image path the rings might be varied in cross section to compensate for varying topography.

Such large antennas are still electrically small and efficient. Therefore they offer great promise in the lower frequency ranges such as the extra low frequency (ELF) range. It is well known that frequencies in that range deeply penetrate sea water enabling reliable communication transmissions to submerged submarines. For some time the U.S. Navy has been attempting to build an ELF antenna for submarine communication at 78 Hz. See, OE-2 *IEEE J. of Oceanic Eng.* 161 (1977). The proposed Navy antenna, a slight variation of the Beverage wave antenna devised in the 1920's (see, 42 *Trans. AIEE* 215 (1923)), covers an area 100 miles by 100 miles and is atrociously inefficient. At 78 Hz, a free space wavelength is 3.85 Mm long. An antenna according to the invention having a maximum dimension of 0.003 free space wavelengths, a dimension believed attainable at 78 Hz, would be about 11.5 km (seven miles) across, would be self-resonant and would have a high radiation efficiency. While ohmic losses might be a significant consideration in such a large structure, it is obvious that an antenna occupying less than one tenth the area taken up by the Navy's Project Sanguine/Seafarer antenna will have much reduced ohmic losses if the same size conductors are used. Since no antenna embodiment of the inventive structure has yet been built to operate in the ELF region, it is not known how small such an antenna can be made. But it is believed that it could be even smaller than 0.003 free space wavelengths, with no sacrifice in directive gain. Harrington, *Time Harmonic Electromagnetic Fields* (McGraw-Hill 1961) 278–79 and 307–11, points out that there is no theoretical limit to antenna size reduction for a specified gain. My conclusion is based on measurements of a structure according to the invention having a resonant frequency at 138 KHz and a resistive feedpoint impedance of 900 ohms at that resonance. The maximum overall dimension of this embodiment was 0.007 free space wavelengths at the resonance frequency. This performance compares very well with the U.S. Navy's 15 KHz transmitter at Cutler, Maine which occupies over a square mile, is about 0.1 free space wavelength overall, and operates at only 50 percent efficiency, largely because of its non-resonant operation.

The Inventive Structure As A Waveguide Probe. It is known that the earth's surface and the ionosphere form a cavity has certain natural resonant frequencies. The resonances of this cavity are regularly excited by lightning. These resonance phenomena were apparently first analytically described in two articles by Schumann in 1952, 72 *Z. Naturforsch.* 149 and 250 (1952). Measurements of the cavity resonance frequencies indicate they occur at about 8, 14 and 20 Hz, as well as at higher frequencies. Galejs, *Terrestrial Propagation of Long Electromagnetic Waves,* 241 (1972). Although the theoretical attenuation with distance of electromagnetic waves at the cavity resonance frequencies varies depending upon the propagation model used and atmospheric assumptions, it is known that the attenuation is quite small. See, Galejs, ibid., at 254. For example, the attenuation at 8 Hz is less than 0.25 dB/per million meters. Since half the circumference of the earth is approximately 20 million meters, propagation at 8 Hz using the earth-ionosphere cavity from any point on the earth to any other point on the earth with a loss no greater than 5.0 dB appears to be possible.

However, no one yet built a practical waveguide probe capable of exciting the earth—ionosphere cavity at 8 Hz where the wavelength is about 37.5 million meters. This failure is attributable to the poor radiation efficiency and physical size limitations for such probes in the previously known technology. However, with my invention, a waveguide probe of reasonable size can be built which can efficiently excite the earth—ionosphere cavity at the primary Schumann resonance frequency. An embodiment of my inventive contrawound structure employing the earth as an image current source and having a maximum dimension of 0.001 free space wavelengths, and probably much smaller, can be built to launch vertically polarized, omnidirectional energy efficiently into the cavity at its primary resonant frequency. While the embodiment of the structure is physically large, perhaps 10 to 20 miles across, it still occupies less than four percent of the area of the Project Sanguine/Seafarer antenna which is supposed to operate at a frequency ten times higher.

My invention has been described with respect to certain preferred embodiments. Various additions and modifications without departing from the spirit of the invention will occur to those of skill in the art. Accordingly, the scope of my invention is limited solely by the following claims.

I claim:

1. An electromagnetic antenna including a plurality of closed, interconnected ring elements spaced from each other and transversely disposed on a multiply connected surface.

2. The invention of claim 1 further including conducting bridge elements longitudinally disposed on said surface, said bridge elements electrically connecting said ring elements.

3. The invention of claim 2 wherein said multiply connected surface is the outside surface of an endless tube and said conducting ring and bridge elements are electrically divided into four substantially identical sections of ring and bridge elements, said sections being electrically connected in parallel.

4. A process for radiating or receiving electromagnetic energy comprising conducting an electrical current through a path of closed, interconnected conducting ring elements spaced from each other and transversely disposed on a multiply connected surface, and establishing, in response to the flow of said current, an electromagnetic wave along said surface in a condition of resonance.

5. The process of claim 4 wherein said path includes a plurality of conducting bridge elements longitudinally disposed on said surface, said bridge elements electrically connecting said ring elements.

6. The process of claim 5 wherein said multiply connected surface is the outside surface of an endless tube, including the steps of electrically dividing said conducting ring and bridge elements into four substantially identical sections of ring and bridge elements and electrically connecting said sections in parallel before conducting said current.

7. An electromagnetic antenna including first and second substantially closed, elongated conductors helically disposed on the same multipy connected surface.

8. The invention of claim 7 wherein said first and second conductors are disposed in bifilar relation.

9. The invention of claim 7 including phasing means connected to said first conductor for controlling the relative phases of currents flowing in said first and second conductors.

10. The invention of claim 7 including frequency adjustment means connected to said first conductor for adjusting the frequencies at which said antenna may resonate.

11. The invention of claim 10 wherein said frequency adjustment means comprises a variable reactance.

12. The invention of claim 7 wherein said surface is the outside surface of an endless tube.

13. A process for radiating or receiving electromagnetic energy comprising conducting first and second electrical currents, respectively, through first and second substantially closed, elongated conductors helically disposed on the same multiply connected surface and establishing, in response to the flow of said currents, an electromagnetic wave along said surface in a condition of resonance.

14. The process of claim 13 wherein said first and second conductors are disposed in bifilar relation.

15. The process of claim 13 including controlling the relative phases of said first and second currents.

16. The process of claim 13 including altering the frequencies at which said electromagnetic wave may be established along said surface in a condition of resonance.

17. The process of claim 16 wherein said altering step comprises altering the reactance of a variable reactance connected to said first conductor.

18. The process of claim 13 wherein said surface is the outside surface of an endless tube.

19. An electromagnetic antenna comprising a plurality of ring elements, each ring element including a conducting ring element portion and an image means for electromagnetically completing each ring element, said conducting ring element portions being spaced from each other and transversely disposed on the outside surface of an endless tube.

20. The invention of claim 19 wherein said image means conprises a plurality of radially disposed, conducting linear elements, one of said conducting linear elements being electrically connected to each of said conducting ring element portions.

21. The invention of claim 19 wherein said image means comprises the earth and each said conducting ring element portion is in contact with the earth.

22. The invention of claim 19 wherein said conducting ring element portions are divided into four substantially identical sections of conducting ring element portions, said sections being electrically connected in parallel.

23. A process for radiating or receiving electromagnetic energy comprising conducting an electrical current through a path of ring elements, each ring element including a conducting ring element portion and an image means for electromagnetically completing each said ring element, said conducting ring element portions being spaced from each other and transversely disposed on the outside surface of an endless tube, and establishing, in response to the flow of said current, an electromagnetic wave along said surface in a condition of resonance.

24. The process of claim 23 wherein said image means includes a plurality of radially disposed, conducting linear elements, one of said conducting linear elements being electrically connected to each of said conducting ring element portions.

25. The process of claim 23 wherein said image means includes the earth and each conducting ring element portion is in contact with the earth.

26. The process of claim 23 including dividing said conducting ring element portions into four substantially identical sections of conducting ring element portions and electrically connecting said sections in parallel before conducting said current.

* * * * *